United States Patent [19]

Marullo

[11] Patent Number: 5,072,959

[45] Date of Patent: Dec. 17, 1991

[54] BOAT CARRIER

[76] Inventor: Gaetano C. Marullo, 1752 Nanton St., NW., Palm Bay, Fla. 32907

[21] Appl. No.: 611,041

[22] Filed: Nov. 9, 1990

[51] Int. Cl.[5] ..... B60P 3/10

[52] U.S. Cl. ..... 280/47.331; 114/344

[58] Field of Search ..... 280/47.331, 47.131, 280/414.2, 414.1, 638, 35, 63; 114/344

[56] References Cited

U.S. PATENT DOCUMENTS

| | | | |
|---|---|---|---|
| 2,540,279 | 2/1951 | Mosier | 280/414.2 |
| 2,688,494 | 9/1954 | Wilson | 280/47.13 |
| 2,818,268 | 12/1957 | Johnson | 280/42 |
| 2,970,846 | 2/1961 | Boston | 280/40 |
| 3,093,386 | 6/1963 | Case | 280/42 |
| 3,687,476 | 8/1972 | Abbott | 280/47.32 |
| 4,392,665 | 7/1983 | Miller et al. | 280/414.2 |
| 4,422,665 | 12/1983 | Hinnant | 280/414.2 |
| 4,429,893 | 2/1984 | Palamara | 114/344 |
| 4,754,988 | 7/1988 | Hofgren | 114/344 |
| 4,801,152 | 1/1989 | Elliot et al. | 280/47.34 |
| 4,822,065 | 4/1989 | Enders | 114/344 |
| 4,824,127 | 4/1989 | Stamm | 114/344 |
| 4,936,595 | 6/1990 | Cunningham | 114/344 |

*Primary Examiner*—David M. Mitchell

[57] ABSTRACT

A boat carrier is provided for manually transporting a canoe in the field. The device allows a user to pull the canoe and any fishing gear to any distance in one easy trip. The boat carrier includes a quick disassemble frame for receiving the canoe near the midsection, a pair of transversely spaced-apart heavy terrain wheels attached to the frame, and a pair of hold down brackets for resiliently securing the canoe to the frame assembly.

3 Claims, 2 Drawing Sheets

BOAT CARRIER

BACKGROUND OF THE INVENTION

The present invention relates generally to canoe and small boat transport. The outdoorsman has always been burdened by transportation problems created by the wilderness. Thick forests, murky swamps, muddy roads and rocky terrain present difficulties to a traveler loaded with gear and water transportation.

Boat trailers are commonly used for hauling the gear and the boat to the wilderness site. The trailer may be attached to the outdoorman's vehicle or the boat may be mounted on the roof of the vehicle.

Boat trailers pulled by a vehicle are inadequate for use in the field. Lightweight boats, attached to the roof of the vehicle, are appropriate for field use but when combined with other outdoor gear, create traveling problems. Accordingly, there is a need for a boat trailer for use in the field that is easy to carry and hauls the boat in the field. As for handicapped individuals, transporting a boat or canoe through the wilderness is even more of a problem. The art has simply failed to provide ground transportation for the handicapped attempting to carry a canoe through rough terrain.

Several prior art attempts to provide an easy to handle quick disassembly boat dolly have failed because of poor design. For example, Wilson U.S. Pat. No. 2,688,494, shows a boat beaching gear having a pair of hooklike side members connected by a line of rope that runs underneath the boat. Unfortunately, the arrangement taught by Wilson requires the outdoorsman to use rope and angle iron creating an unstable vehicle likely to collapse in rough terrain such as a swamp or a marsh. Other attempts, such as those disclosed in U.S. Pat. Nos. 4,392,665 and 4,801,152, are fine for pavement but are mechanically unsound for field use.

It is still further an object of the present invention to provide a boat carrier means that can collapse into a small package for compact storage.

The above mentioned and other features and objects of this invention and the manner of attaining them will become more apparent and the invention itself will be best understood by reference to the following description of an embodiment of the invention taken in conjunction with the accompanying drawings.

SUMMARY OF THE INVENTION

In accordance with purpose of this invention, there is provided a boat carrier for manually transporting a boat or a canoe. The boat carrier includes an easy to assemble frame for receiving the boat or canoe near one end thereof, a pair of wheels detachably mounted to the frame a lateral support bar, a pair of corner braces, a pair of hold down brackets each and a pair of rope loops each having one end running through a portion of the corner brace and the other end positioned over a projection on the top of the hold down brackets.

The ropes provide flexible support for securing the boat onto the boat carrier and offer a means for quickly and easily removing the frame assembly from the canoe.

In a preferred embodiment, the boat carrier includes a pair of cord clamps each pivotally attached to the outside of each corner brace. Each cord clamp has a receiver for gripping one end of each rope. The cord clamps may be pivoted downward against each side of each corner brace for securing the boat on the boat carrier.

In view of the above, it is an object of the present invention to provide a means for easily transporting a boat on land.

It is further an object of the present invention to provide a means for transporting a boat that is simple in design and easy to use.

It is further an object of the present invention to provide a means for transporting a boat that is simple in design and easy to use.

It is further an object of the present invention to provide a means for transporting a boat that can be easily attached upon a boat or removed therefrom.

It is further a object of the present invention to provide a means for transporting a boat that is adjustable, able to be secured on boats of a wide range of sizes.

It is further an object of the present invention to provide a boat carrier means that is easy and inexpensive to manufacture.

It is further an object of the present invention to provide a boat carrier means that can be handled by one person.

DESCRIPTION OF THE PREFERRED EMBODIMENT

Figure 1:
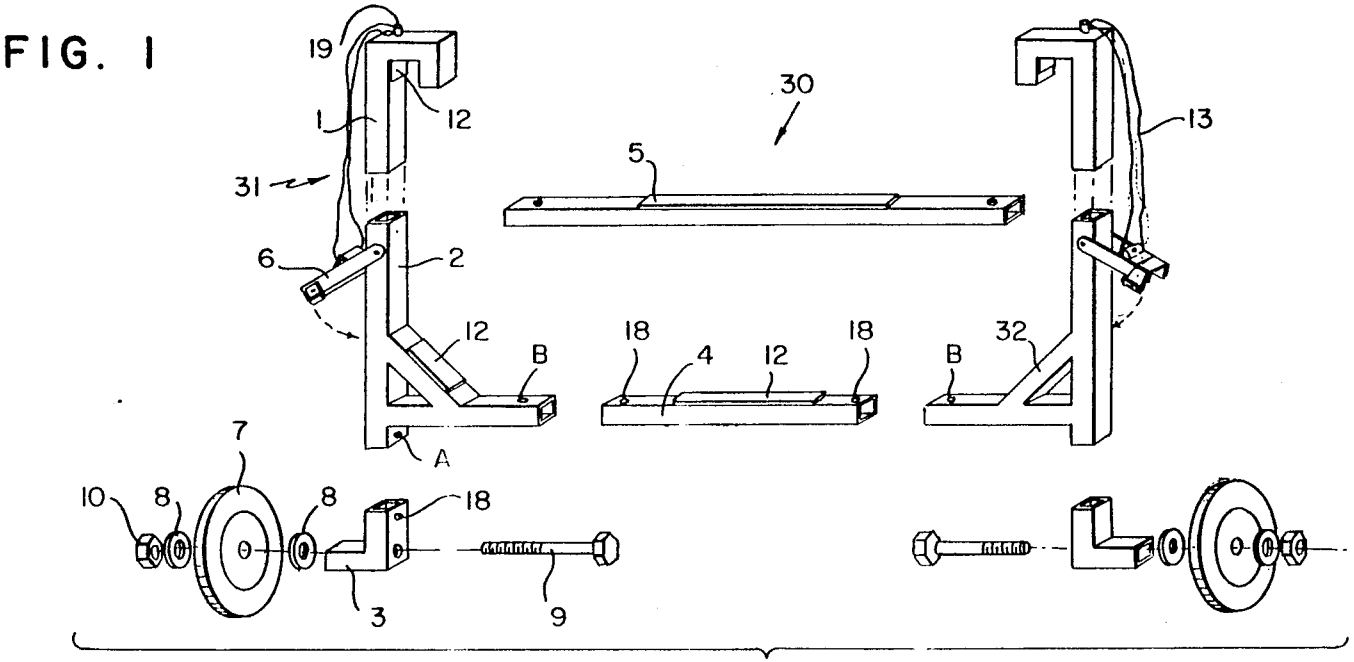
FIG. 1 is a front view of the boat carrier with a boat attached.

Referring to FIG. 1, a boat (1) having a hull (1*a*) is mounted for travel on the subject boat carrier (2). The boat carrier may provide land transportation to any type of small boat including canoes, paddle boats, fishing boats and tube boats.

Figure 2:
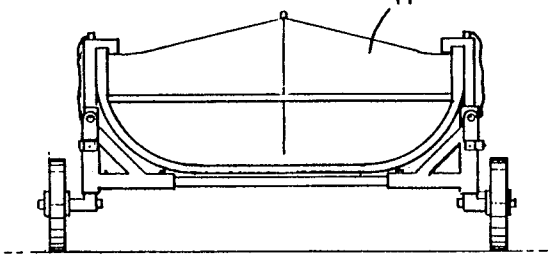
FIG. 2 is an exploded front view of the boat carrier.

The boat carrier, as shown disassembled in FIG. 2, includes a frame assembly (3). The frame assembly includes parts that are hollow and rectangular shaped for telescoping connection. The parts are preferably made of metal or heavy plastic.

The frame assembly (3) has two identical half sections connected by a lateral support bar (4) which will be described in detail later. Each half section includes a hold down bracket (5) having a J-shaped design with a hook (6), a top surface (7) provided with a projection (8). The projection extends from the top surface (7) at least ¼ inch. The bracket has a lower end (9) of reduced cross section.

Each half section further includes a corner brace (10) having a vertical section (11) with four side walls (12), a cross piece (13) and a horizontal section (14). The vertical section (11) has a hollow upper end (15) for telescopingly receiving the lower end (9) of the hold down bracket (5). The vertical section (11) has a bottom end (16) with an aperture (17) provided on the inside wall (12*a*) of the corner brace. The horizontal section (14) includes an aperture (18) on upper surface (19).

The frame assembly also includes a wheel assembly (20) for (11) has a bottom end (16) with an aperture (17) provided on the inside wall (12*a*) of the corner brace. The horizontal section (14) includes an aperture (18) on upper surface (19).

The frame assembly also includes a wheel assembly (20) for each half section. The wheel assembly (20) utilizes a wheel connector frame (21) having a reduced top end (22) and a foot (23). The wheel connector frame has an inside wall (24) provided with an upper aperture (25) and a larger hole (26). A bolt (27) is fitted into the hole (26) and extends through foot (23) to connect wheel (28), spacers (29) and nut (30) to wheel connector frame (21). The foot extends the wheel (28) away from the wheel connector frame to assure easy operation of the wheel. The reduced top end (22) of the wheel frame connector slides inside bottom end (16) of the corner brace such that apertures (17) and (25) are in mating relationship.

Figure 3:
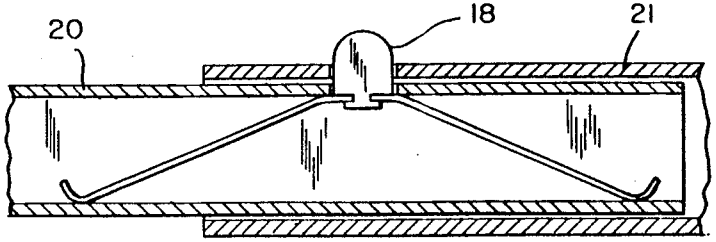
FIG. 3 is a cross-sectional view of the spring clip.

As illustrated in FIG. 3, a spring biased pin (31) is positioned inside the top end (22) and extends through apertures (25) and (17) to lock the wheel connector frame to the corner brace. Pressing in the pin below the wall (12*a*) allows the release of the wheel connector frame and the corner brace.

The lateral support bar (4) has reduced end portions (35) with apertures (36). The reduced end portions are slid inside each end (37) of the corner braces until each aperture (18) of the corner brace mates with apertures (36) of the lateral support bar. Also provided inside each end (35) of the lateral support bar (4) are spring bias pins (40) which extend through apertures (18) and (36) to lock the lateral support bar (4) to the corner braces (10). The lateral support bar may be horizontally adjustable or may come in different lengths to suit the type of boat or canoe.

Figure 4:
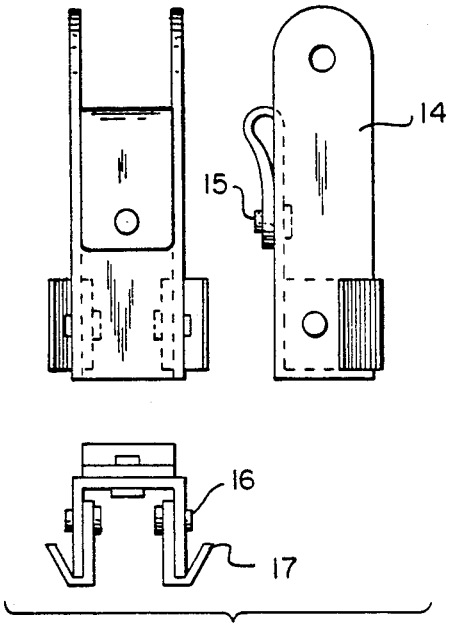
FIG. 4 is a cross-sectional view of the cord clamp used on side frame.
Figure 5:
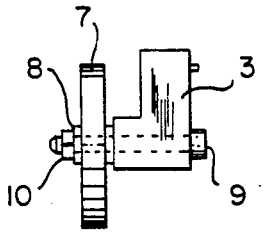
FIG. 5 is a front view of the wheel assembly.
Figure 6:
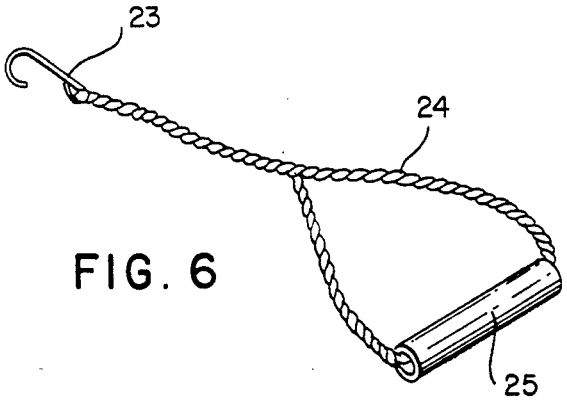
FIG. 6 is a detailed view of the pull handle.
Figure 7:
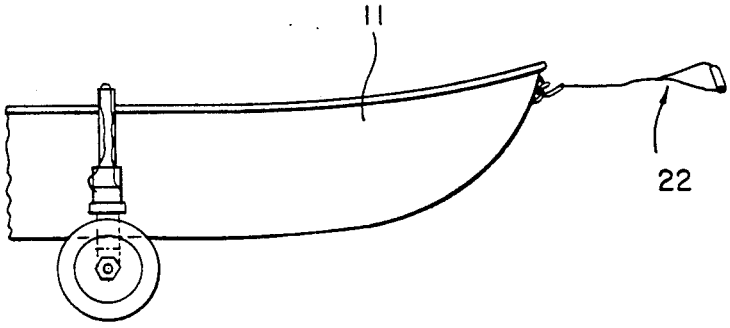

With reference now to FIGS. 2, 4, 5 each half section also includes a clamp and rope assembly (50). The clamp and rope assembly has a cord clamp (51) which includes arms (52) pivotally attached to side walls (12) of the corner brace. The cord clamp (51) has a receiver (53) that is provided with an aperture (54). Flanges (55) are provided on each side wall (56) of arms (52). The cord clamp is generally of U-shaped configuration as best shown in FIG. 6. The cord clamp is pivotally mounted (7) by a fastener (59).

As broadly illustrated in FIG. 2, each half section is provided with a nylon rope loop (60) having a first end (61) and a second end (62). The first end is secured by the receiver (53) and the second end is wound over projection (8). After the entire frame assembly is assembled, the second end (61) of the rope loop is wound around the projection and the cord clamp (5) is pulled down until the cord clamp (51) is snug against the vertical portion (11) of the corner brace. The cord clamp (51) pulls the rope loop taught securing the hold down bracket into the hull of the boat. The carrier is assembled and attached to the boat as illustrated in FIG. 1. Release of the cord clamp upwardly frees the rope loop (60) allowing the user to disassemble the carrier.

The frame assembly (2) also includes a pad support system made up of resilient rubber pads (71) adhered to the inner walls (12) of the frame assembly (2) to prevent damage to the boat hull during transportation.

While there have been described above the principles of this invention in connection with specific apparatus, it is to be clearly understood that this description is made only by wa of example and not as a limitation to the scope of the invention.

I claim:

1. A boat carrier for securing and transporting a boat having a hull, the boat carrier comprising;

a pair of hold down brackets, each bracket having a hook, each hook having an upper surface, each upper surface having a vertically extending projection, a pair of corner braces, each corner brace having a vertical portion and a horizontal portion, each portion having walls, each corner brace connected to each corresponding hold down bracket, a pair of wheel assemblies, each wheel assembly including at least one wheel, each wheel assembly connected to each respective corner brace, a lateral support bar, said lateral support bar having a first end and a second end, each end connected to each respective corner brace.

a pair of cord clamps, each clamp pivotally mounted to each vertical portion of each corner brace, each cord clamp having a receiver, each cord clamp having a first position and a second locking position, and a pair of rope loops, each loop having a first end and a second end, each loop having said first end held by said respected receiver and said second end wound around said projection, whereby pivoting each cord clamp from said first position to said second position secures each hold down bracket to each respective corner brace and secures said boat hull to said carrier.

2. The boat carrier as described in claim 1 further comprising pin means for connecting each wheel assembly to each respective corner brace.

3. The boat carrier as described in claim 1 further comprising pin means for connecting each corner brace to each end of said lateral support.

* * * * *